US006748675B2

(12) United States Patent
Sato

(10) Patent No.: US 6,748,675 B2
(45) Date of Patent: Jun. 15, 2004

(54) SOLE ASSEMBLY FOR SPORTS SHOE

(75) Inventor: Natsuki Sato, Osaka (JP)

(73) Assignee: Mizuno Corporation, Osaka (JP)

( * ) Notice: Subject to any disclaimer, the term of this patent is extended or adjusted under 35 U.S.C. 154(b) by 28 days.

(21) Appl. No.: 10/163,555

(22) Filed: Jun. 5, 2002

(65) Prior Publication Data

US 2002/0184793 A1 Dec. 12, 2002

(30) Foreign Application Priority Data

Jun. 7, 2001 (JP) ..... 2001-171918
Jun. 4, 2002 (JP) ..... 2002-162794

(51) Int. Cl.[7] ..... A43B 7/32; A43B 13/18; A43B 13/38; A43C 13/04

(52) U.S. Cl. ..... 36/30 R; 36/28; 36/44; 36/59 C

(58) Field of Search ..... 36/30 R, 59 R, 36/114, 28, 29, 141, 44, 31, 59 C, 3 R, 3 B

(56) References Cited

U.S. PATENT DOCUMENTS

| | | | | | |
|---|---|---|---|---|---|
| 1,559,450 | A | | 10/1925 | Oakley | |
| 1,749,351 | A | * | 3/1930 | McQueen | 36/59 R |
| 2,260,138 | A | * | 10/1941 | Feinberg | 36/59 R |
| 4,255,874 | A | | 3/1981 | Sironi | |
| 4,398,357 | A | | 8/1983 | Batra | |
| 4,546,559 | A | * | 10/1985 | Dassler | 36/114 |
| 4,747,220 | A | | 5/1988 | Autry et al. | |
| 5,367,791 | A | * | 11/1994 | Gross et al. | 36/31 |
| 5,526,589 | A | * | 6/1996 | Jordan | 36/29 |
| 5,595,003 | A | * | 1/1997 | Snow | 36/28 |
| 5,799,415 | A | * | 9/1998 | Kenji et al. | 36/44 |
| 5,815,951 | A | * | 10/1998 | Jordan | 36/29 |
| 6,023,859 | A | * | 2/2000 | Burke et al. | 36/28 |
| 6,389,713 | B1 | * | 5/2002 | Kita | 36/28 |

FOREIGN PATENT DOCUMENTS

| | | | | |
|---|---|---|---|---|
| DE | 3035706 | | 6/1982 | |
| EP | 1044619 | | 10/2000 | |
| JP | 62-27123 | | 7/1987 | |
| JP | 1-27684 | | 9/1989 | |
| JP | 7-30709 | | 6/1995 | |
| JP | 8-22241 | | 3/1996 | |
| WO | WO 92/03069 | A1 * | 3/1992 | |
| WO | WO 93/03639 | A1 * | 3/1993 | A43B/13/18 |

* cited by examiner

*Primary Examiner*—Anthony D. Stashick
(74) *Attorney, Agent, or Firm*—W. F. Fasse; W. G. Fasse

(57) ABSTRACT

A sole assembly (1) for a sports shoe includes an upper layer (10), a middle layer (20) and a lower layer (30), which are integral with each other. The upper layer (10) and the lower layer (30) are formed of soft elastic materials, such as foamed rubber or the like. The middle layer (20) has a sheet (22) formed of synthetic resin or synthetic rubber with a hardness greater than that of the upper layer (10) and the lower layer (30). The sheet (22) has a plurality of protrusions or cleats (21) of truncated cone-shape that protrude downwardly and that are formed integrally with the sheet (22). The lower layer (30) has a plurality of through holes (31) receiving respective cleats (21) for insertion thereinto. The lower layer (30) made of a soft elastic member secures gripping properties and shock absorbing properties. An edge portion of a distal end **(21*a*) of the cleat (21)** advances the gripping properties by contacting the ground.

15 Claims, 7 Drawing Sheets

SOLE ASSEMBLY FOR SPORTS SHOE

TECHNICAL FIELD OF THE INVENTION

The present invention relates in general to a sole assembly for a sports shoe, and more particularly to a sole assembly formed of three layers of an upper layer, a middle layer and a lower layer, especially for an indoor shoe.

BACKGROUND OF THE INVENTION

A sports shoe is generally divided into two categories; an outdoor shoe and an indoor shoe. In the soles of these shoes, various structures and different materials have been used according to the characteristics of sports.

In an outdoor shoe, an outsole made of synthetic rubber has been used from the viewpoint of gripping abilities, and an outsole made of synthetic resin has been used from the viewpoint of durability. Further, in an outsole made of synthetic resin and having increased gripping properties, cleats or spikes made of metal or synthetic resin have been provided under the bottom surface of the outsole.

On the other hand, in an indoor shoe, gripping abilities, shock absorbing properties, and lighter weight become more important because indoor sports typically require hard movements in a vertical and horizontal direction. Thus, an outsole made of synthetic rubber has been employed and a sole has been constructed from two or three layers.

Also, an outsole has been formed of a plurality of materials and various improvements have been introduced into an outsole in order to further improve properties of the ground surface or sole surface of the outsole.

Japanese utility model examined publication No. 62-27123 shows a sole having a sole body made of hard synthetic resin, a plurality of chips made of hard synthetic resin and a plurality of rubber chips, which are integrally formed with each other through fabric.

Japanese utility model examined publication No. 1-27684 discloses a sole made of synthetic resin, studs formed integrally with the sole and made of synthetic resin, and rubber studs fitted into through holes formed in the sole.

Japanese utility model unexamined publication No. 7-30709 shows a sole having two layers formed of an inner sole and an outsole of hard synthetic resin, tip ends of a plurality of protrusions formed integrally with the lower surface of the inner sole extend into respective through holes formed in the outsole, and compressible, elastic members are interposed between the inner sole and the outer sole.

Japanese patent application examined publication No. 8-22241 shows a sole with an outsole having a plurality of cleats provided thereon and having thin-walled portions formed around the cleats on the outsole.

The sole shown in publication No. 62-27123 is directed to achieving non-slipping properties through rubber chips and wear resistance through chips made of hard synthetic resin. Two kinds of chips are required to control non-slipping properties and wear resistance of the sole, and fabrics are needed to make the chips integrated with the sole.

In the sole disclosed in publication No. 1-27684, both plastic studs and rubber studs protrude from the bottom surface or sole surface of the sole, and such a sole is suitable only for outdoor sports such as baseball, soccer or the like, as is described in the publication.

The sole shown in publication No. 7-30709 is directed to absorbing shock load during activities through elastic deformation of an elastic member provided between the inner sole and the outsole and to achieving gripping power relative to the ground through the protrusions of the inner sole that come into contact with the ground. As is described in the publication, this sole is applicable only to an outdoor shoe such as a tennis shoe.

The sole shown in publication No. 8-22241 is directed to improving non-slipping properties by making a thickness of the outsole thinner at the peripheries of the cleats so that the cleats can incline independently. This sole is also applicable only to an outdoor shoe.

The present invention is directed to providing a sole assembly for a sports shoe, especially for an indoor shoe, which can improve gripping abilities and shock absorbing properties.

SUMMARY OF THE INVENTION

The sole assembly according to the present invention is constructed from an upper layer, a middle layer and a lower layer that are integrated with each other. The upper and lower layers are formed of a soft elastic material, and the middle layer has a sheet formed of synthetic rubber or resin of a hardness greater than those of the upper and lower layers. The sheet has a plurality of protrusions or cleats depending therefrom, and the lower layer has a plurality of through holes receiving respective cleats.

According to the present invention, the lower layer formed of a soft elastic material improves gripping abilities at the time of kicking or pushing the ground and shock absorbing properties at the time of striking onto the ground. Also, the upper layer formed of a soft elastic material improves cushioning properties on landing and contact feeling of a foot. Moreover, since a sheet of a greater hardness is provided between the upper and lower layers, excessive depression of the upper and lower layers can be prevented at the time of loading a shock load, thereby impeding lateral deformation of the upper and lower layers to improve stability of a shoe.

Furthermore, in this case, the protrusions of the sheet inserted into the through holes of the lower layer come into contact with the ground, thus making gripping abilities and shock absorbing properties controllable.

In this case, since the protrusions are not provided in such a way to protrude overly from the sole surface, the sole assembly especially suitable for an indoor shoe can be achieved.

The protrusions may be formed of the same material as the sheet and formed integrally with the sheet. Alternatively, the protrusions may be formed of a different material than the sheet and combined with the sheet to form a unit.

A clearance may be formed between an outer circumferential surface of each protrusion and an inner circumferential surface of a respective associated through hole. In this case, the protrusions come to incline or deform laterally inside the respective through holes at the time of contacting the ground, thereby enabling an edge portion of a distal end of the protrusion to come into contact with the ground, which can further improve gripping abilities of the protrusion.

The protrusion is preferably in the shape of a truncated cone, whose diameter becomes gradually smaller as it goes toward a distal end of the protrusion. In this case, since a clearance between the protrusion and the through hole becomes greater as it goes toward a distal end of the protrusion, a distal end portion of the protrusion can incline or bend laterally in every direction on a contact plane after landing, thereby securing gripping abilities and shock absorbing properties in the whole direction on the contact plane.

The distal end of the protrusion may be flush with or below the contact surface of the lower layer. Alternatively, the distal end of the protrusion may protrude from the contact surface of the lower layer. The length of the protrusion relative to the thickness of the lower layer depends on the required gripping abilities, compressive hardness (or hardness to deform relative to the compressive force) of the lower layer, characteristics of sports, or weight of a shoe wearer.

In a preferred embodiment, a sheet is formed of a wavy corrugated sheet that has a wavy corrugation at least at a heel portion of the sheet. In this case, at the time of loading a shock load, a wavy corrugated portion of the corrugated sheet displays compression suppressing effect and prevents the upper and lower layers from being depressed excessively and deforming laterally, thereby further improving stability of a shoe. Moreover, in this case, prevention of depression of the upper and lower layers enables a transfer from landing to pushing the ground to occur smoothly. Thereby, each protrusion comes to transmit gripping power to the ground securely at the time of pushing or kicking the ground.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
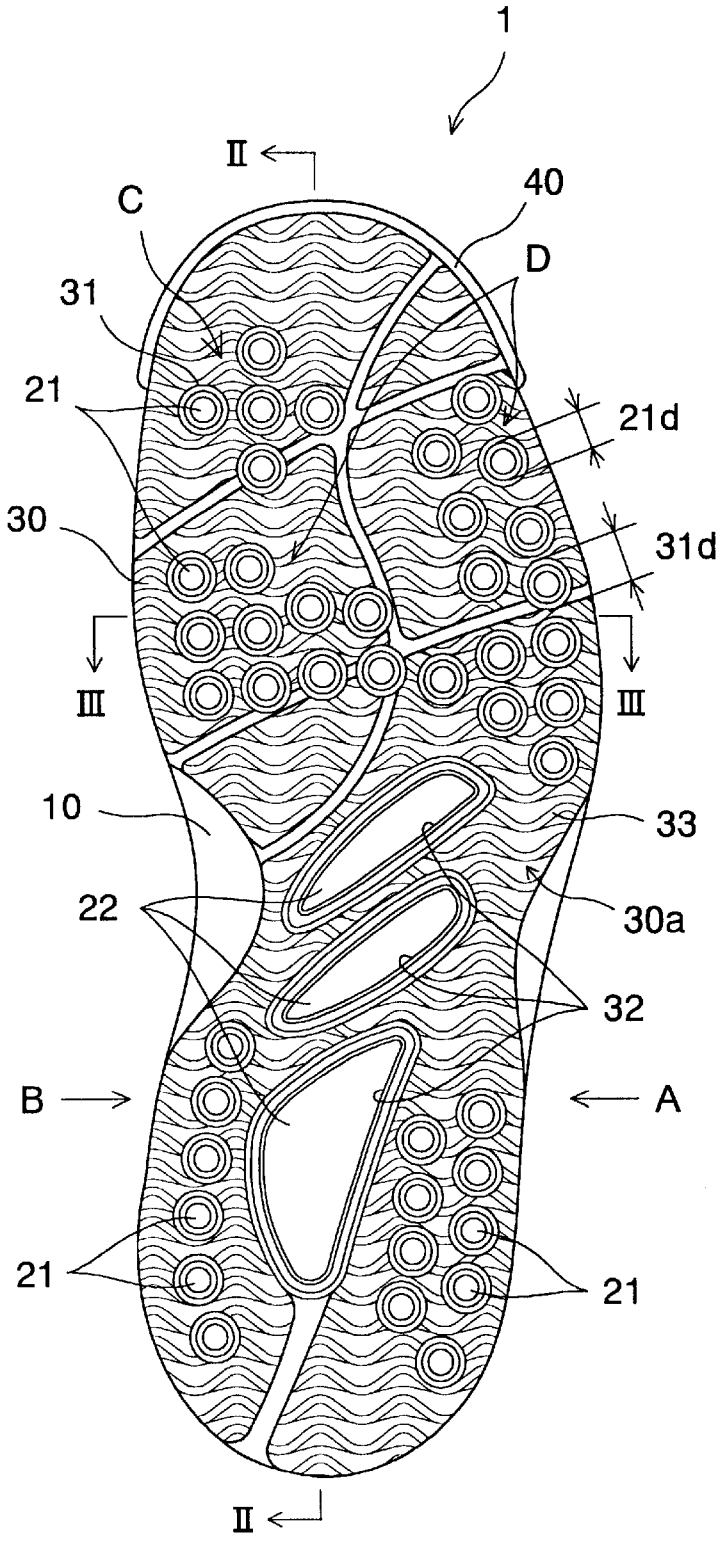
FIG. 1 is a bottom view of a sole assembly of a sports shoe according to an embodiment of the present invention.
Figure 2:
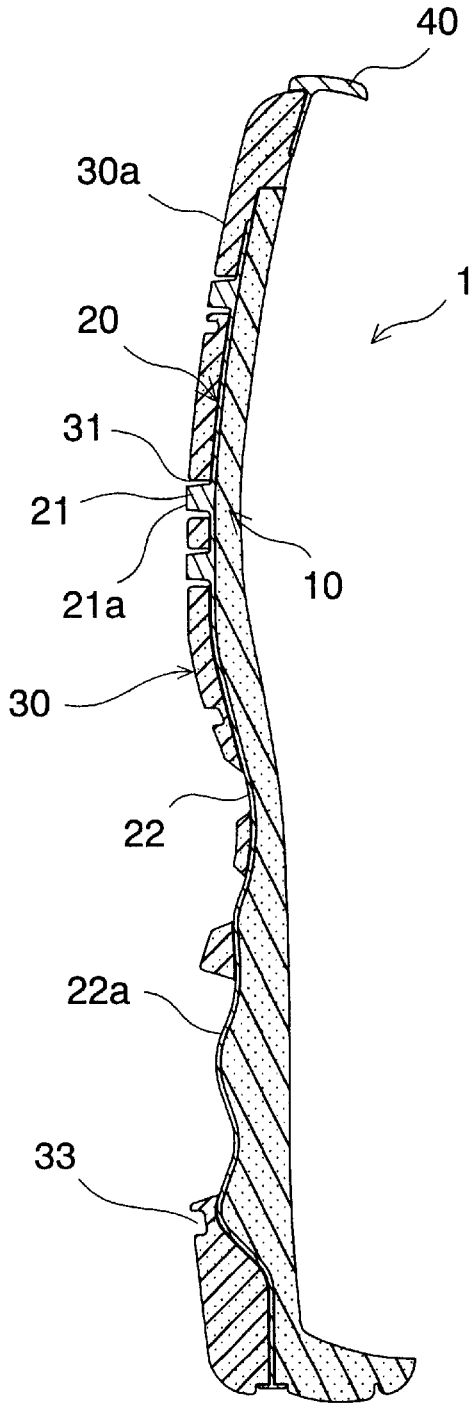
FIG. 2 is a cross sectional view of FIG. 1 taken along line II—II.
Figure 3:
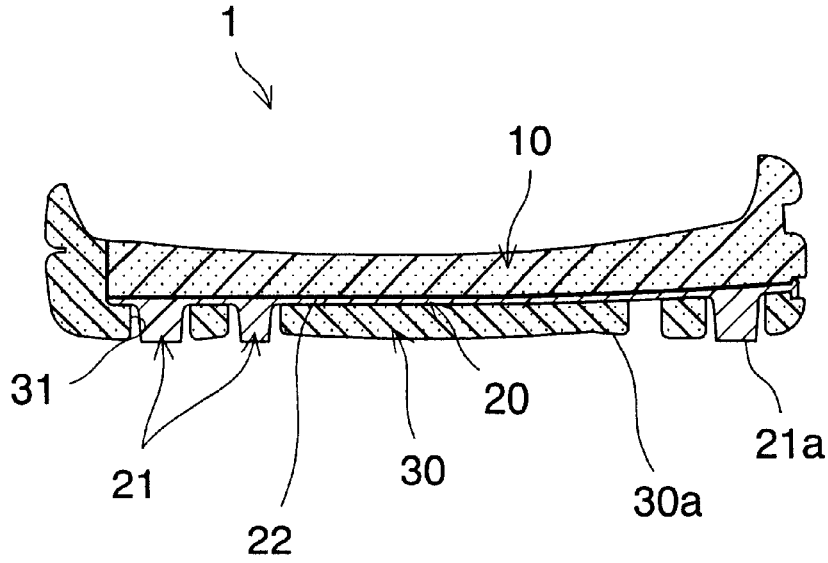
FIG. 3 is a cross sectional view of FIG. 1 taken along line III—III.

Turning now to the drawings, FIGS. 1–3 illustrate a sole assembly generally at 1.

The sole assembly 1 is formed of an upper layer 10, a middle layer 20 and a lower layer 30, which are integrated with each other. The upper and lower layers 10, 30 extend from a heel portion to a forefoot portion of a shoe. The upper and lower layers 10, 30 are formed of soft elastic materials, such as foamed polyurethane, foamed ethylene-vinyl acetate copolymer (EVA), foamed rubber materials, or the like. Hardness of the upper and lower layers 10, 30 is preferably 40–80 at JIS (Japanese Industrial Standards) C scale, and relative density of the upper and lower layers 10, 30 is 0.1–0.9. Thickness of the upper and lower layers 10, 30 is preferably 3–20 mm. In addition, the upper and lower layers 10, 30 may be composed of the same materials. Alternatively, the layers 10, 30 may be composed of different materials.

Here, the hardness of the upper layer 10 is set at 40–80 of JIS C scale in order to improve cushioning properties and foot contact feeling. The hardness of the lower layer 30 is set at 40–80 of JIS C scale in order to improve gripping abilities and shock absorbing properties. If the hardness is smaller than 40 of JIS C scale, the sole softens and lacks stability. If the hardness is greater than 80 of JIS C scale, the sole tightens and lacks cushioning properties and gripping abilities.

Also, the thickness of the upper and lower layers 10, 30 is set at 3–20 mm in order to improve stability and shock absorbing properties. If the thickness is smaller than 3 mm, vertical deformation becomes small and the sole lacks shock absorbing properties and cushioning properties. If the thickness is greater than 20 mm, the whole vertical deformation becomes greater and the sole lacks stability.

The middle layer 20 extends from the heel portion to the forefoot portion of the shoe and is formed of a sheet 22 sandwiched between the upper layer 10 and the lower layer 30. The sheet 22 has a wavy corrugated portion 22*a* at least at a heel portion thereof. The sheet 22 is preferably formed of synthetic rubber having a hardness of 50–90 at JIS A scale. In the alternative, thermoplastic resin such as polyurethane, polyamide elastomer, ABS resin and the like, or thermosetting resin such as epoxy resin, polyester resin and the like may be used. Thickness of the sheet 22 is preferably 0.5–3 mm for durability and stability.

Here, the hardness of the middle layer 20 is set at 50–90 at JIS A scale in order to prevent excessive depression and lateral deformation of the upper and lower layers 10, 30 to improve stability of a shoe. If the hardness is smaller than 50 of JIS A scale, deformation of a portion of the sheet 22, especially a wavy corrugated portion 22*a* becomes too large and the sole lacks stability. If the hardness is greater than 90 of JIS A scale, bendability of a portion of a shoe, especially a forefoot portion decreases.

In this embodiment, the upper and lower layers 10, 30 are formed of foamed EVA having a hardness of 60 at JIS C scale. The middle layer 20 is formed of a sheet 22 of hard synthetic rubber having a hardness of 90 at JIS A scale and protrusions 21 that are integrated with the sheet 22. The upper, middle and lower layers 10, 20 and 30 which have been formed independently, are combined to form a unit by bonding, heating and pressing them relative to each other. Thereafter, a sole assembly 1 will be completed by attaching a toe guard 40 of synthetic rubber to a toe portion.

The sheet 22 has a plurality of protrusions 21 depending therefrom and protruding toward the ground contact surface. The lower layer 30 has a plurality of through holes 31 formed therein for receiving respective protrusions 21. Each protrusion 21 is fitting into the respective through holes 31.

The protrusions 21 are properly arranged at regions where gripping forces are needed according to characteristics of sports. In this embodiment, shown in FIG. 1, there are provided 9 pieces of protrusions 21 at a heel lateral portion A and 6 pieces of protrusions 21 at a heel medial portion B. 5 pieces at a pollex portion C and 23 pieces at a forefoot bending and lateral portion D are also provided.

Each protrusion 21 is preferably formed of the same material as the sheet 22 and preferably formed integrally with the sheet 22. Alternatively, the protrusions 21 may be formed separately from the sheet 22 using a different material from the sheet 22, and thereafter, the protrusions 21 may be combined with the sheet 22 to form a unit by bonding, heat and press forming, or insert forming. In either case, for an indoor shoe, the protrusions 21 are preferably formed of synthetic rubber from the standpoint of gripping abilities. Additionally, when the protrusions 21 and the sheet 22 are formed in separate processes, each color of the protrusions 21 and the sheet 22 is easy to be changed, thereby advancing possibility of modifications of designs.

The length of each protrusion 21 is properly determined according to the required gripping abilities, compressive hardness (or hardness to deform relative to the compressive force) of the lower layer 30, characteristics of sports, weight of a shoe wearer, or the like. In this embodiment, each protrusion 21 is 2–21 mm in length, which corresponds to the thickness, 3–20 mm, of the lower layer 30. The distal end 21*a* of the protrusion 21 protrudes about 0.5 mm from the contact surface 30*a* of the lower layer 30.

The protrusion 21 is preferably in the shape of a truncated cone, whose diameter becomes gradually smaller as it goes toward a distal end 21*a* of the protrusion 21. The through hole 31 of the lower layer 30 preferably has a cylindrical shape adapted to house the protrusion 21 of a truncated cone shape. In this embodiment, the diameter 21*d* of a proximal portion of the truncated-cone-shaped protrusion 21 is about 9 mm, and the diameter 31*d* of the hole 31 is about 12 mm.

As a shape of a protrusion 21, in addition to a truncated cone shape of a circular shape in cross section, a generally truncated cone shape of an oval shape or a spindle shape in cross section, a truncated pyramid shape or a prism shape of a square shape in cross section may be adopted. Furthermore, an outer circumferential surface of a protrusion 21 may be formed into a curve along the outline of the sole.

On the contact surface 30*a* of the lower layer 30, a plurality of slip prevention grooves 33 are formed to prevent slipping from occurring. At the heel portion and the midfoot portion of the lower layer 30, apertures 32 are formed to decrease the weight of the whole sole assembly.

In the sole assembly 1, by regulating the degree of ground contact of the distal end 21*a* of the protrusion 21, gripping abilities and shock absorbing properties can be controlled.

For example, when higher gripping abilities are required, the length of the protrusion 21 is made relatively longer in such a way that the distal end 21*a* of the protrusion 21 is protruded from the contact surface 30*a* of the lower layer 30. On the other hand, when higher gripping abilities are not required, the length of the protrusion 21 is made relatively shorter in such a way that the distal end 21*a* of the protrusion 21 is flush with or below the contact surface 30*a* of the lower layer 30.

Also, when a wearer's weight is relatively heavier, the length of the protrusion 21 is made relatively shorter so that cushioning properties can be secured on the contact surface 30*a* of the lower layer 30. In contrast, when a wearer's weight is relatively lighter, the length of the protrusion 21 is made relatively longer so that gripping abilities by the protrusion 21 can be achieved.

In this case, because the protrusion 21 is in the shape of a truncated cone, a clearance is securely formed between the inner circumferential surface of the hole 31 and the outer circumferential surface of the distal end portion of the protrusion 21, thereby allowing the protrusion 21 to incline or bend in every direction on the contact plane after contacting the ground. Thus, the edge portion of the distal end 21*a* of the protrusion 21 can come into contact with the ground in all directions on the contact plane, and as a result, gripping abilities and shock absorbing properties in all directions can be advanced.

In this case, since the protrusions 21 of the sheet 22 are provided not to overly protrude from the contact surface 30*a* of the lower layer 30 but to be fitted into the respective holes 31 formed in the sheet 30, a sole assembly suitable especially for an indoor shoe is achieved.

Moreover, in this case, the sheet 22 has a wavy corrugation formed at least at a heel portion thereof. At the time of loading a shock load, a wavy corrugated portion 22*a* of the sheet 22 prevents excessive depression of the upper and lower layers 10, 30 by displaying compression preventing effect. Thereby, lateral deformation of the upper and lower layers 10, 30 can be securely prevented and thus, stability of a shoe can be further improved. Also, by prevention of excessive depression of the upper and lower layers 10, 30, transition from the state of striking onto the ground to the state of pushing or kicking the ground can be conducted more smoothly, and thus, gripping power by the protrusions 21 of the sheet 22 can be securely transmitted to the ground at the time of pushing or kicking the ground. Also, the wavy corrugated portion 22*a* of the sheet 22 can prevent boundary separation between the upper layer 10 and the lower layer 30.

Figure 4:
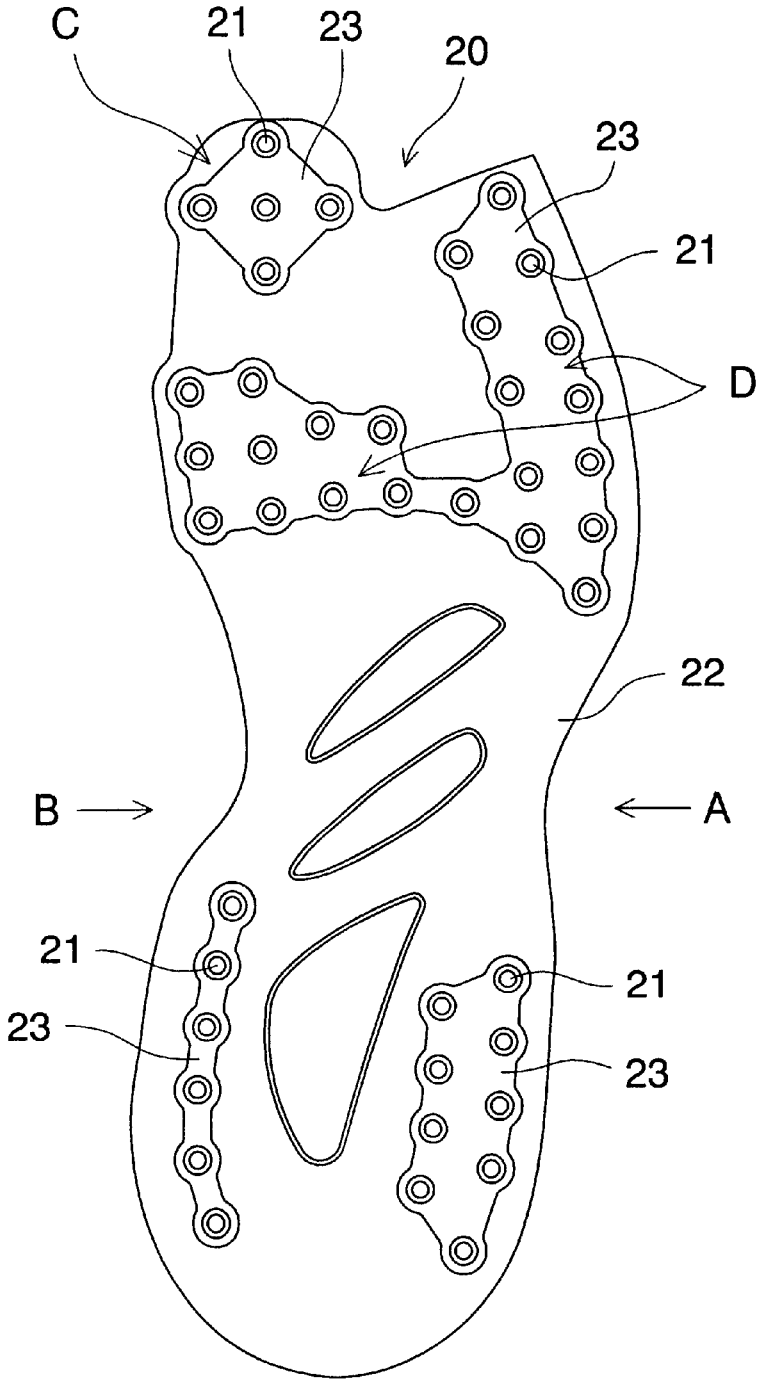
FIG. 4 is a bottom view of a variant of a middle layer forming the sole assembly.

As shown in FIG. 4, each protrusion 21 provided on the sheet 22 may be connected with each other through connecting sheets 23 at a heel lateral portion A, a heel medial portion B, a pollex portion C and a forefoot bending and lateral portion D. The connecting sheets 23 may be formed of the same material as the protrusions 21.

FIG. 4 also shows a sheet 22 having a plurality of protrusions each in the shape of a truncated cone similar to one in the above-mentioned embodiment. Here, the sheet 22 is formed of hard synthetic rubber of a hardness of 90 at JIS A scale, and protrusions 21 and connecting sheets 23 are formed of soft synthetic rubber of a hardness of 60 at JIS A scale, separately from the sheet 22. Thereafter, the sheet 22 and connecting sheets 23 with protrusions 21 are formed integrally with each other through a process of curving, heating and pressing.

Figure 5:
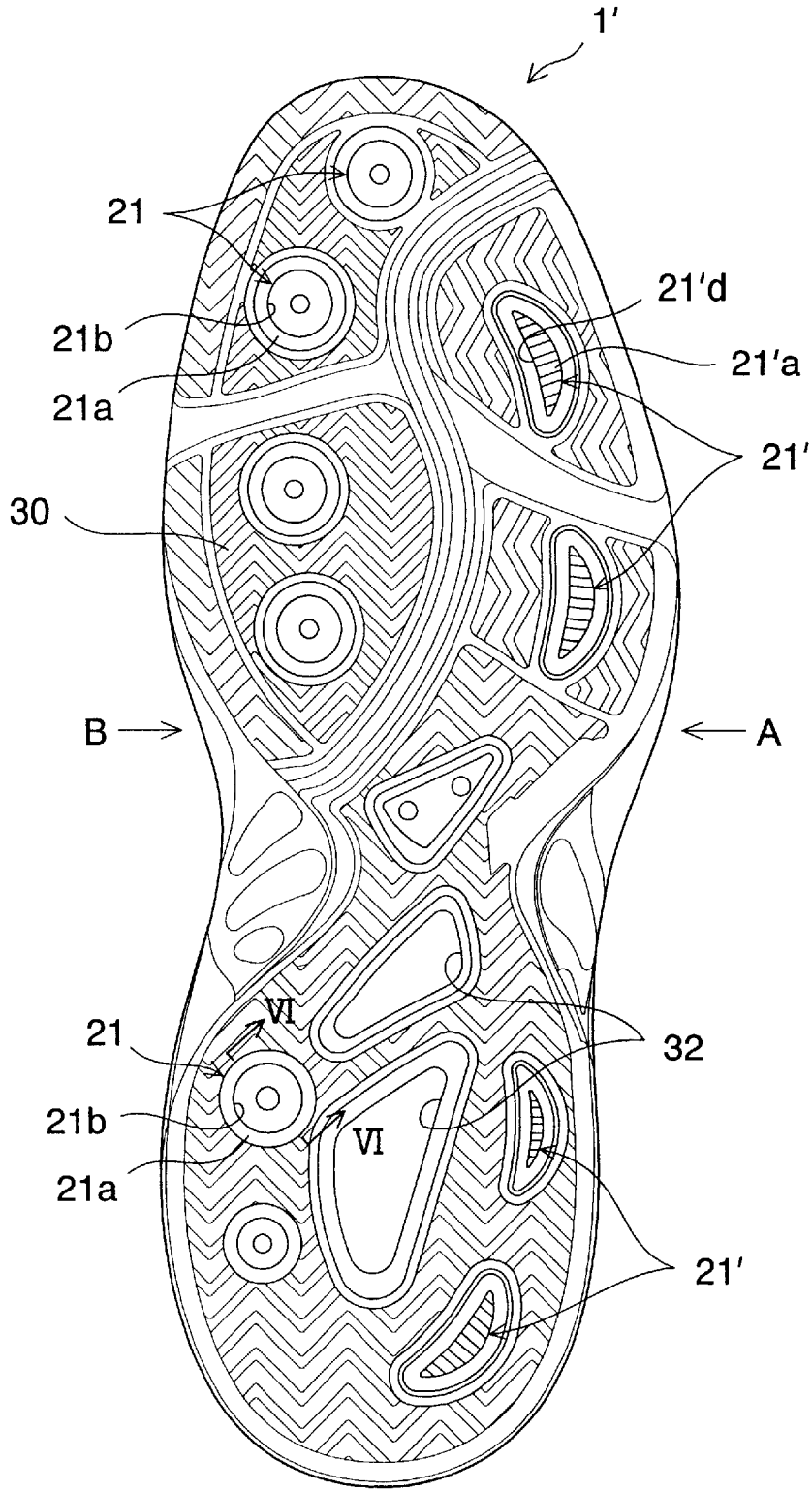
FIG. 5 is a bottom view of a sole assembly of a sports shoe according to another embodiment of the present invention.
Figure 6:
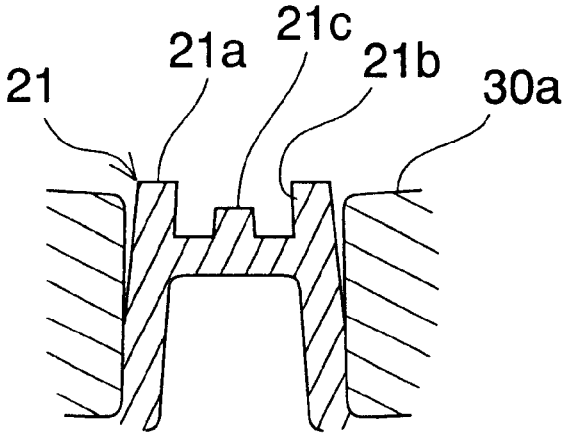
FIG. 6 is a cross sectional view of FIG. 5 taken along line VI—VI.
Figure 7:
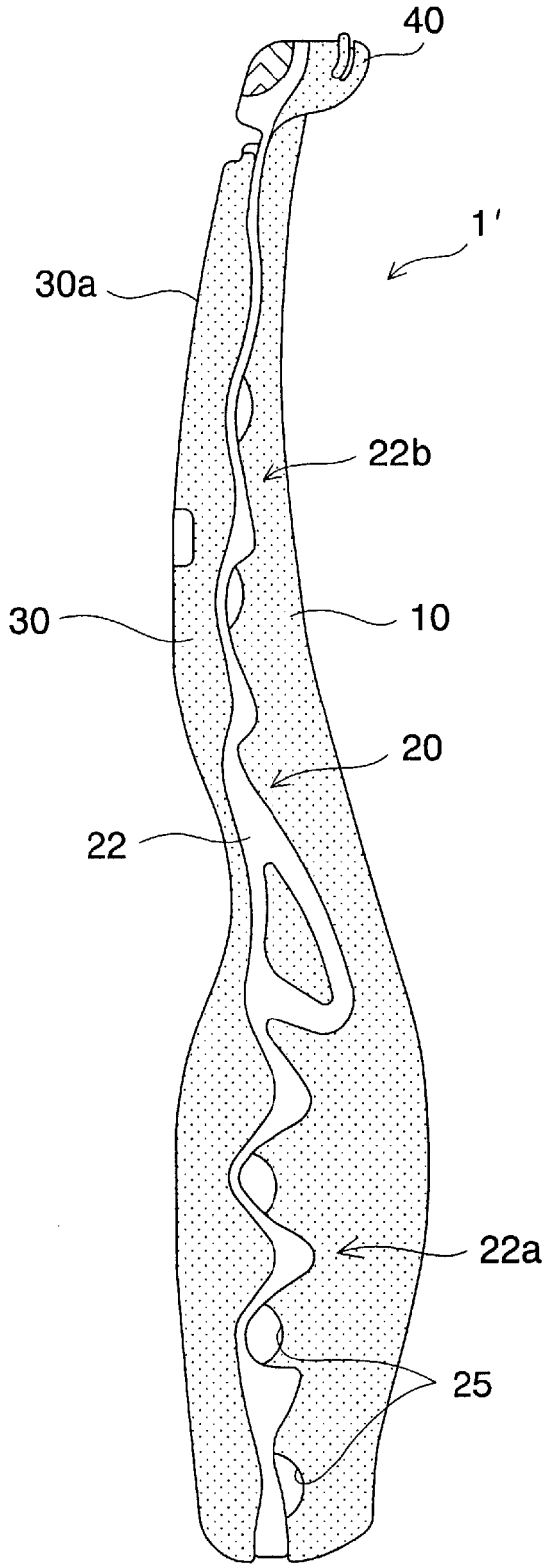
FIG. 7 is a lateral side view of the sole assembly of FIG. 5.

Next, FIGS. 5–7 show a sole assembly for a sports shoe according to another embodiment of the present invention. In these drawings, the same reference numerals as those in the above-mentioned embodiment indicate the same or corresponding parts of the sole assembly.

As shown in FIG. 5, there are provided two types of protrusions 21 and 21' of different shapes in a sole assembly 1'. The protrusion 21 has a shape of a truncated cone similar to one in the above-mentioned embodiment, but it is larger than the protrusion 21 of FIG. 1. The distal end 21*a* of the protrusion 21, shown in FIG. 6, has a circumferential groove 21*b* formed thereon, and distal end 21*a* of a band-shape extends circumferentially. In the center of the protrusion 21 is formed a cylindrical protrusion 21*c*, the tip end of which is disposed slightly below the distal end 21*a* of the protrusion 21.

The protrusion 21' has flat D-shaped or crescent-shaped cross section, which becomes gradually smaller as it goes toward the distal end thereof. A generally flat pressure surface 21'*d* is formed at a side wall of the protrusion 21', which faces the medial side B.

In this sole assembly 1', shown in FIG. 7, a wavy corrugated portion 22*b* is also provided at a forefoot portion of the sheet 22. Therefore, in this case, lateral deformation of the sole forefoot portion can be securely prevented, and thus, stability as a sole is achieved at the sole forefoot portion as well. Also, by preventing excessive depression of the sole forefoot portion, gripping power by the protrusions 21, 21' of the sole forefoot portion can be securely transmitted to the ground at the time of kicking or pressing the ground.

Moreover, in this sole assembly 1', since the distal end 21*a* of the protrusion 21 is band-shaped, the distal end 21*a* is easy to bend or incline in every direction, thereby improving gripping abilities of the protrusions 21. Furthermore, in this case, the cylindrical protrusion 21*c* of the protrusion 21 comes into contact with the ground as the distal end 21*a* of the protrusion 21 deforms, thereby advancing gripping abilities of the protrusions 21 step by step.

Also, since a larger pressure surface 21'*d* is secured by making a cross section of each protrusion 21' crescent-shaped or flat D-shaped, in indoor sports, especially basketball where hard lateral movements are required, each pressure surface 21'*d* of the protrusions 21' effectively acts relative to lateral movements of a shoe and displays a stopping function successfully. Additionally, in the sole assembly 1', a plurality of cushion holes 25 are formed in the upper layer 10 to improve cushioning properties of the sole.

The present invention may be applied to a sole assembly for an outdoor shoe. In this case, durability of protrusions can be improved by forming the protrusions of hard synthetic resin, and piercing properties of the protrusions can be advanced by making the protrusions cone-shaped or pyramid-shaped according to the characteristics of sports.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole assembly for a sports shoe comprising:

an upper layer (10) formed of a first soft elastic material;

a lower layer (30) that includes an outer ground contact surface and has plural through holes (31) penetrating entirely through said lower layer and opening through said outer ground contact surface, and that is disposed under said upper layer (10) and formed of a second soft elastic material; and a middle layer (20) including a sheet (22) and plural protrusions (21) that are permanently connected to and protrude from said sheet;

wherein said sheet is interposed between and permanently connected to said upper layer (10) and said lower layer (30) to form thereof an integral sole unit, and said sheet is formed of synthetic rubber or synthetic resin with a hardness greater than a respective hardness of said upper layer (10) and of said lower layer (30);

wherein said protrusions (21) respectively extend into said through holes (31), whereby a clearance is formed between an outer circumference of a respective one of said protrusions and a respective one of said through holes through which said protrusion extends.

2. The sole assembly of claim 1, wherein said protrusions (21) are formed of the same material as said sheet (22) and formed integrally with said sheet (22).

3. The sole assembly of claim 1, wherein said protrusions (21) are formed of a different material from said sheet (22) and combined with said sheet (22) to form a unit.

4. The sole assembly of claim 2, wherein said protrusions (21) are formed of synthetic rubber.

5. The sole assembly of claim 3, wherein said protrusions (21) are formed of synthetic rubber.

6. The sole assembly of claim 1, wherein one of said protrusions (21) has a shape of a truncated cone with a diameter that becomes smaller toward a distal end (21*a*) thereof.

7. The sole assembly of claim 1, wherein a distal end (21*a*) of one of said protrusions (21) protrudes outwardly beyond said outer ground contact surface (30*a*) of said lower layer (30).

8. The sole assembly of claim 1, wherein a distal end (21*a*) of one of said protrusions (21) is flush with said outer ground contact surface (30*a*) of said lower layer (30).

9. The sole assembly of claim 1, wherein a distal end (21*a*) of one of said protrusions (21) is recessed in said lower layer to be closer than said outer ground contact surface (30*a*) to said upper layer.

10. The sole assembly of claim 1, wherein said sheet (22) comprises at least a wavy corrugated sheet portion having a wavy corrugation at least at a heel portion of said sheet (22).

11. The sole assembly of claim 1, wherein said clearance extends entirely through a thickness of said lower layer, so that no part of said respective protrusion contacts any part of a side wall of said respective through hole.

12. The sole assembly of claim 1, wherein said protrusions are uncovered and outwardly exposed through said through holes and are dimensioned and positioned to be adapted to come into direct contact with a ground which said ground contact surface of said lower layer is adapted to contact.

13. The sole assembly of claim 1, for said sports shoe being an indoor sports shoe, wherein said protrusions are dimensioned, positioned and suitable for contacting an indoor floor surface.

14. The sole assembly of claim 1, wherein said upper layer, said lower layer, and said middle layer are laminated and directly surfacially bonded to one another for permanently connecting said layers to form thereof said integral sole unit.

15. A sole assembly for a sports shoe comprising:

an upper layer (10) formed of a first soft elastic material;

a lower layer (30) that includes an outer ground contact surface and has plural through holes (31) penetrating entirely through said lower layer and opening through said outer ground contact surface, and that is disposed under said upper layer (10) and formed of a second soft elastic material; and a middle layer (20) including a sheet (22) and plural protrusions (21) that are connected to and protrude from said Sheet;

wherein said sheet is interposed between said upper layer (10) and said lower layer (30) and is permanently connected to said lower layer, and said sheet is formed of synthetic rubber or synthetic resin with a hardness greater than a respective hardness of said upper layer (10) and of said lower layer (30);

wherein said protrusions (21) respectively extend into said through holes (31), whereby said protrusions are uncovered and outwardly exposed through said through holes and are dimensioned and positioned to be adapted to come into direct contact with a ground which said ground contact surface of said lower layer is adapted to contact.

* * * * *